US009133005B2

(12) United States Patent
Graffin

(10) Patent No.: US 9,133,005 B2
(45) Date of Patent: Sep. 15, 2015

(54) METHOD FOR FILLING CONTAINERS TO A CONSTANT LEVEL WITH A STILL OR A SPARKLING LIQUID, AND A FILLING NOZZLE FOR THE IMPLEMENTATION OF THIS METHOD

(71) Applicant: Serac group, La Ferte Bernard (FR)

(72) Inventor: Jean-Jacques Graffin, Winfield, IL (US)

(73) Assignee: Serac Group, La Ferte Bernard (FR)

( * ) Notice: Subject to any disclaimer, the term of this patent is extended or adjusted under 35 U.S.C. 154(b) by 477 days.

(21) Appl. No.: 13/623,550

(22) Filed: Sep. 20, 2012

(65) Prior Publication Data

US 2013/0068344 A1 Mar. 21, 2013

(30) Foreign Application Priority Data

Sep. 20, 2011 (FR) ..... 11 58372

(51) Int. Cl.
*B67C 3/26* (2006.01)

(52) U.S. Cl.
CPC ..... *B67C 3/262* (2013.01); *B67C 3/2628* (2013.01)

(58) Field of Classification Search
CPC ..... B67C 3/26; B67C 3/2614; B67C 3/262; B67C 3/2625; B67C 3/2628; B67C 2003/2602
USPC ..... 141/59, 198, 302, 303
See application file for complete search history.

(56) References Cited

U.S. PATENT DOCUMENTS

| | | | | |
|---|---|---|---|---|
| 2,794,455 | A | 6/1957 | Day | |
| 3,415,295 | A | 12/1968 | Wolf | |
| 3,782,427 | A | 1/1974 | Zeimet | |
| 4,206,789 | A | 6/1980 | Jordan | |
| 4,369,820 | A * | 1/1983 | Ahlers et al. | 141/39 |
| 2014/0366985 | A1 * | 12/2014 | Graffin | 141/286 |

FOREIGN PATENT DOCUMENTS

| | | |
|---|---|---|
| DE | 22 60 063 | 6/1974 |

* cited by examiner

*Primary Examiner* — Jason K Niesz
(74) *Attorney, Agent, or Firm* — Muncy, Geissler, Olds & Lowe, P.C.

(57) ABSTRACT

The method for filling containers comprises the following stages: closing an exhaust duct in a calibrated manner (61,62) according to a calibration to an exhaust pressure that is lower than the distribution pressure; placing into position a container to be filled; opening a distribution valve (24) and keeping it open until the closure of an exhaust check valve (46); closing the distribution valve (24).

10 Claims, 3 Drawing Sheets

METHOD FOR FILLING CONTAINERS TO A CONSTANT LEVEL WITH A STILL OR A SPARKLING LIQUID, AND A FILLING NOZZLE FOR THE IMPLEMENTATION OF THIS METHOD

The present invention relates to a method for filling containers to a constant level with a still or a sparkling liquid and a filling nozzle for the implementation of this method.

BACKGROUND TO THE INVENTION

For the purpose of filling containers to a constant level with a still liquid, filling nozzles are previously disclosed comprising an annular connection part configured to provide a liquid-tight support with a neck of a container and to demarcate a distribution zone; a distribution tube connected to a source of supply of a liquid under a distribution pressure by means of a distribution valve and discharging into the distribution zone; an exhaust duct discharging on the one hand into the distribution zone, and on the other hand via a vent orifice, and an exhaust check valve controlled by a liquid level sensor inside the exhaust duct, interposed in the exhaust duct between the distribution zone and the vent orifice. When filling a container, the air that is present inside the container is expelled by the liquid as it is introduced into the container and escapes via the vent orifice. When the liquid reaches the lower extremity of the exhaust duct, the liquid rises in the exhaust duct and causes the closure of the exhaust check valve. The distribution valve is then closed, and the container is separated from the annular connection part in such a way that the liquid that is present inside the exhaust duct returns into the container.

These filling nozzles cannot be used for the packaging of sparkling liquids, that is to say liquids containing a gas dissolved in the liquid, because of the de-gassing which occurs at the time of the introduction of the liquid into the container.

Also familiar, in particular from the document U.S. Pat. No. 3,946,770, and from the document U.S. Pat. No. 4,206,789, are devices comprising a highly complex system of tubes and valves positioning the filling nozzle in relation to a pressure vessel containing the liquid to be packaged in such a way as to place the supply vessel and the container under the same pressure. During filling, the air that is initially present inside the container is returned to the supply vessel and thus risks causing pollution of the liquid to be packaged. Furthermore, it is difficult to perform effective cleaning because of the complexity of the circuits.

OBJECT OF THE INVENTION

One aim of the present invention is to propose a method and a filling nozzle for implementing this method, in order to perform the filling of containers with a still or a sparkling liquid in a simple manner.

BRIEF DESCRIPTION OF THE INVENTION

With a view to the achievement of this aim, a method is proposed according to the invention for filling containers to a constant level by means of a filling nozzle comprising:

- an annular connection part configured to provide a liquid-tight support with the neck of a container, and to demarcate a distribution zone,
- a distribution tube connected to a source of supply of a liquid under a distribution pressure by means of a distribution valve and discharging into the distribution zone,

- an exhaust duct discharging on the one hand into the distribution zone, and on the other hand via a vent orifice, and
- an exhaust check valve controlled by a liquid level sensor inside the exhaust duct, interposed in the exhaust duct between the distribution zone and the vent orifice, the method comprising the stages of:
- closing the exhaust duct in a calibrated manner according to a calibration to an exhaust pressure that is lower than the distribution pressure, between the exhaust check valve and the vent orifice,
- placing into position a container to be filled, resting against the annular connection part,
- opening the distribution valve and keeping it open until the closure of the exhaust check valve,
- closing the distribution valve,
- releasing the container from the annular connection part.

Thus, at the time of the introduction of the liquid into the container, the air that is present inside the container is compressed until it reaches the calibration pressure so that, in the case of a sparkling liquid, the pressure inside the container opposes a de-gassing of the liquid. At the time of the closure of the distribution valve and the disengagement of the container, the gas under pressure that is trapped between the exhaust check valve and the calibrated valve causes the opening of the exhaust check valve and an accelerated return flow of the liquid that is present inside the exhaust duct towards the container.

According to an advantageous version of the invention, the method comprises in addition a stage of injecting into the exhaust duct, after placing a container in position, a gas at a pressure not exceeding the exhaust pressure. Thus, in the case of a still liquid, the introduction of an inert gas into the container permits the effective level of oxygen to be reduced. By way of example, the introduction into a container at atmospheric pressure of nitrogen at a pressure of 200 kPa causes the proportion of oxygen trapped to fall to one third of its initial value.

The invention also relates to a filling nozzle comprising:

- an annular connection part configured to provide a liquid-tight support with the neck of a container, and to demarcate a distribution zone,
- a distribution tube connected to a source of supply of a liquid under a distribution pressure by means of a distribution valve and discharging into the distribution zone,
- an exhaust duct discharging on the one hand into the distribution zone, and on the other hand via a vent orifice,
- an exhaust check valve controlled by a liquid level sensor inside the exhaust duct, interposed in the exhaust duct between the distribution zone and the vent orifice, and
- a calibrated valve installed between the exhaust check valve and the vent orifice.

According to an advantageous version of the invention, the filling nozzle comprises a gas injection device arranged to permit the injection of gas into a container resting against the annular connection part.

In this case, the gas injection device preferably discharges into the exhaust duct between the exhaust check valve and the vent orifice.

Thus, the gas injection device is not reached by the liquid during filling of the container, which simplifies the cleaning of the filling nozzles.

According to another advantageous aspect of the invention, the filling nozzle comprises a connecting tube discharging on the one hand into the distribution tube, and on the other hand into the exhaust duct, between the exhaust check valve and the vent orifice, and a valve installed in the connecting tube.

Thus, at the time of cleaning the filling nozzle, it is sufficient to pass a cleaning liquid via the distribution tube and to open the valve installed in the connecting tube in order to assure the complete cleaning of the filling nozzle, including the exhaust duct and the exhaust check valve.

Furthermore, the quantity of liquid which rises in the exhaust duct and then returns into the container is a function of the volume of the float assuring the closing actuation of the exhaust check valve. This poses a problem to the extent that the liquid serving to raise the float then returns into the container and runs the risk of being polluted during its passage through the exhaust duct. It is desirable, therefore, to minimize the volume of the exhaust check valve.

According to yet another aspect of the invention, the exhaust check valve is arranged inside a closed enclosure having an upper wall comprising an exhaust orifice surrounded by an upper seat for the exhaust check valve, and the exhaust check valve is a non-return valve installed in such a way as to slide in a valve guide comprising a guide tube having a lower extremity communicating with the exhaust duct and an upper extremity centred on the upper seat of the exhaust check valve, the exhaust check valve furthermore being installed in the guide tube with a free play creating a sufficient loss of pressure for the exhaust check valve to be forced back in the manner of a piston by liquid arriving via the exhaust duct. Thus, an exhaust check valve with a dimension only slightly larger than the upper seat is sufficient to assure the liquid-tight closure of the exhaust orifice in such a way that the volume of liquid necessary for the actuation of the exhaust check valve is very small.

BRIEF DESCRIPTION OF THE DRAWINGS

Other characteristics and advantages of the invention will be appreciated from reading the following description of a preferred, non-limitative mode of implementation of the method according to the invention and of the filling nozzle permitting this implementation, with reference to the accompanying figures, among which.

DETAILED DESCRIPTION OF THE INVENTION

Figure 1:
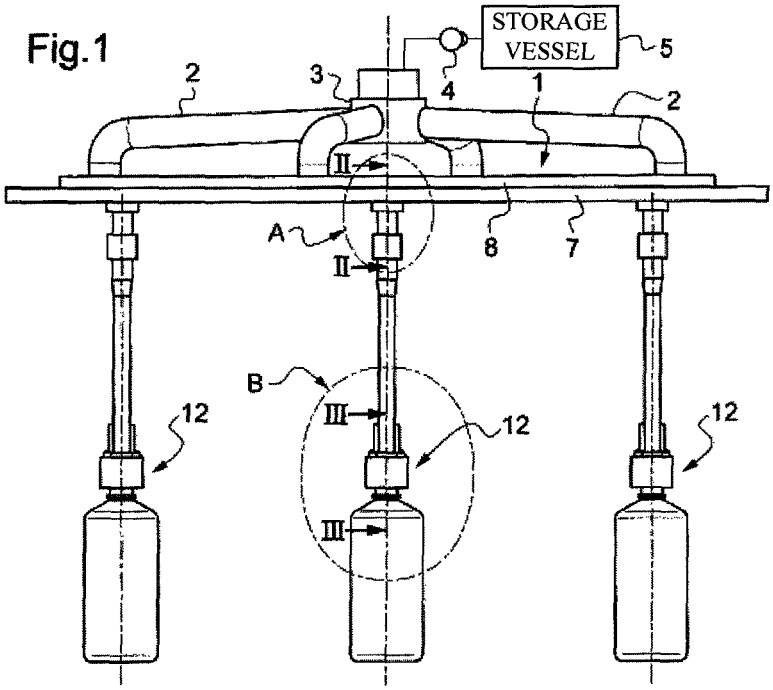
FIG. 1 is a schematic side view of a filling carousel equipped with filling nozzles according to the invention.
Figure 2:
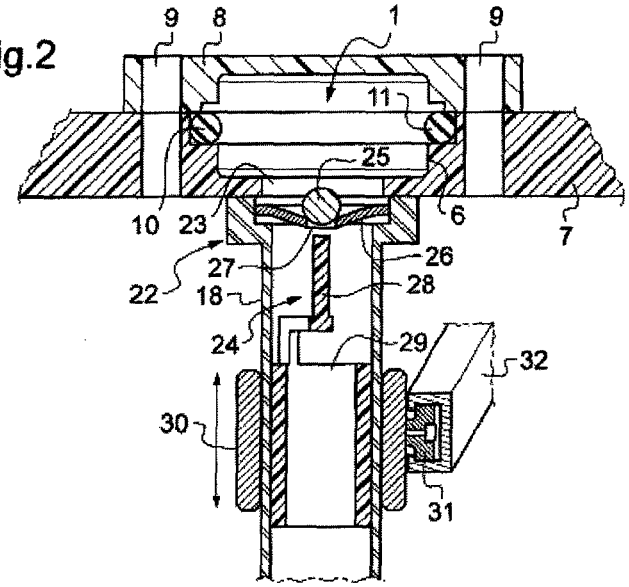
FIG. 2 is a highly enlarged cross-sectional view of the box A in FIG. 1, according to the line II-II in FIG. 1.

With reference to FIG. 1, the filling carousel according to the invention comprises an annular supply collector 1 supplied with a liquid under pressure via radial tubes 2 having an extremity connected to the supply collector 1 and an opposite extremity connected to a rotating joint 3 assuring a connection to a source of supply with a liquid under pressure symbolized by a pump 4 associated with a storage vessel 5. As illustrated in FIG. 2, the collector 1 is formed by an annular groove 6 provided in a plate 7, and closed by an annular cover 8 adequately secured to the plate 7 by means of bolts (not illustrated here) extending into drillings 9, the sealing between the plate 7 and the cover 8 being assured by means of o-rings 10 and 11. Filling nozzles 12 are suspended beneath the plate 7. Each filling nozzle 12 comprises a nozzle body 13 traversed by a vertical bore 14 comprising at its lower part a recess 15, inside which there is installed an annular joint 16 forming an annular connection part configured to provide a liquid-tight support with the neck of a container 17.

A distribution tube formed by a rectilinear tube 18 is installed in the bore 14 and is maintained in place by an o-ring 19 compressed by a screwed bushing 20. The lower extremity of the distribution tube 18 extends into the interior of the container, in which it defines a distribution zone 21. The upper extremity 22 of the distribution tube 18 is fixed beneath the plate 7 and is connected to the supply collector 1 via a drilling 23, by means of a distribution valve 24. In the illustrated embodiment, the distribution valve 24 comprises a ball 25 resting on a bowl 26 installed in a liquid-tight manner across the distribution tube 18 and comprising a distribution orifice 27 having a diameter smaller than that of the ball 25. The ball 25 is actuated by a magnetic actuator comprising a finger 28 carried by a cylindrical magnetic armature 29 arranged in the interior of the distribution tube 18 and the position of which is determined by a magnetic ring 30 installed in an axially mobile manner in relation to the distribution tube 18 and surrounding the latter at the level of the magnetic armature 29. The position of the magnetic ring is determined by an actuating device comprising in this case a guide roller 31 fixed to the magnetic ring 30 and interacting with a guide cam 30. The finger 28 extends coaxially in relation to the distribution orifice 27 of the bowl 26 in such a way that, as a function of the axial movements of the magnetic armature 29, the ball 25 is either resting against the edge of the distribution orifice 27 in order to assure a closure of the supply tube 18, or is moved away from this position by the finger 28 in such a way that liquid under pressure is able to flow through the distribution orifice 27 in the distribution tube 18.

In its lower part, the bore 14 comprises a recess 33, installed in which is a tube 34 which extends coaxially in relation to the distribution tube 18 by being spaced from the latter, and which extends downwards to a point close to the lower extremity of the distribution tube 18. At its upper extremity, the tube 34 is pierced by an orifice 35 which coincides with a drilling 36 in the nozzle body 13. The tube 34 and the drilling 36 thus define a part of an exhaust duct, the upper extremity of which discharges into an exhaust control device 37.

In the illustrated embodiment, the exhaust control device 37 comprises a body 38 comprising a longitudinal drilling 39. At its lower extremity, the drilling 39 discharges into a bore 44 having a diameter greater than the drilling 39 in such a way that the recess between the drilling 39 and the bore 44 defines an upper seat 45 for a non-return valve formed here by a steel ball 46. The expression non-return valve in the sense of the invention is used here to denote a valve having a sufficient density for it to be incapable of being carried by the liquid to be packaged. The ball 46 is installed in an exhaust check valve guide formed in this case by a bushing 47 having a lateral cylindrical wall 48 of the same diameter as the bore 44, provided with an annular flange 49 having identical dimensions to a recess 50 in the bore 48 such that, after press-fitting of the bushing 47 in the body 38 and its fixation on the body 13 by means that are not represented here, the bushing 47 is installed in a liquid-tight manner in the body 38 and is applied in a liquid-tight manner to the body 13. The bushing 47 thus delimits, together with the bore 48, an enclosure 67 provided with an exhaust orifice 45.

Figure 5:
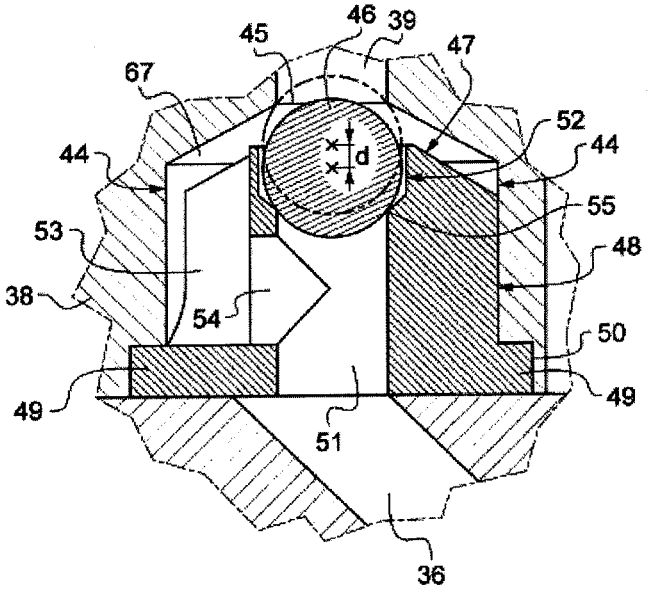
FIG. 5 is a further enlarged view of the box C in FIG. 3.

The bushing 47 comprises a central drilling 51 that is coaxial with the drilling 39 in the body 38 and has the same diameter as the latter. The lower extremity of the drilling 51 coincides with the upper extremity of the drilling 36 in the bloc 13. In the case of the lower extremity of the drilling 39, the bushing 47 comprises an upper drilling 52, coaxial with the drilling 51 forming a guide tube or the ball 46 and having a diameter greater than that of the ball, adapted in order for the free play between the ball 46 and the drilling 52 to create a loss of pressure sufficient for the ball 46 to be forced back in the manner of a piston by liquid arriving via the drilling 36. A free play of between half a tenth of a mm and one tenth of a mm is satisfactory in practice. The recess between the drilling 51 and the bore 52 defines a lower seat 55 for the ball 46. The lower seat 55 is preferably situated at a distance away from the upper seat such that the course d of the ball 46, between the low position represented as a solid line in FIG. 5 and the high position represented as a dashed line, does not exceed the radius of the ball 46.

Furthermore, the bushing 47 comprises a radial drilling 54 of the same diameter as the drilling 51, associated with a lateral notch 53 having a section above the drilling 51 in order to delimit, together with the lateral wall 48 of the enclosure 67, a by-pass tube extending parallel to the guide tube 52 and having a lower extremity discharging below the ball 46 and an upper extremity discharging above the ball 46 when the latter is in a rest position resting against the lower seat 55. The by-pass tube preferably has a volume greater than a volume swept by the exhaust check valve between a low position and a high position.

Figure 3:
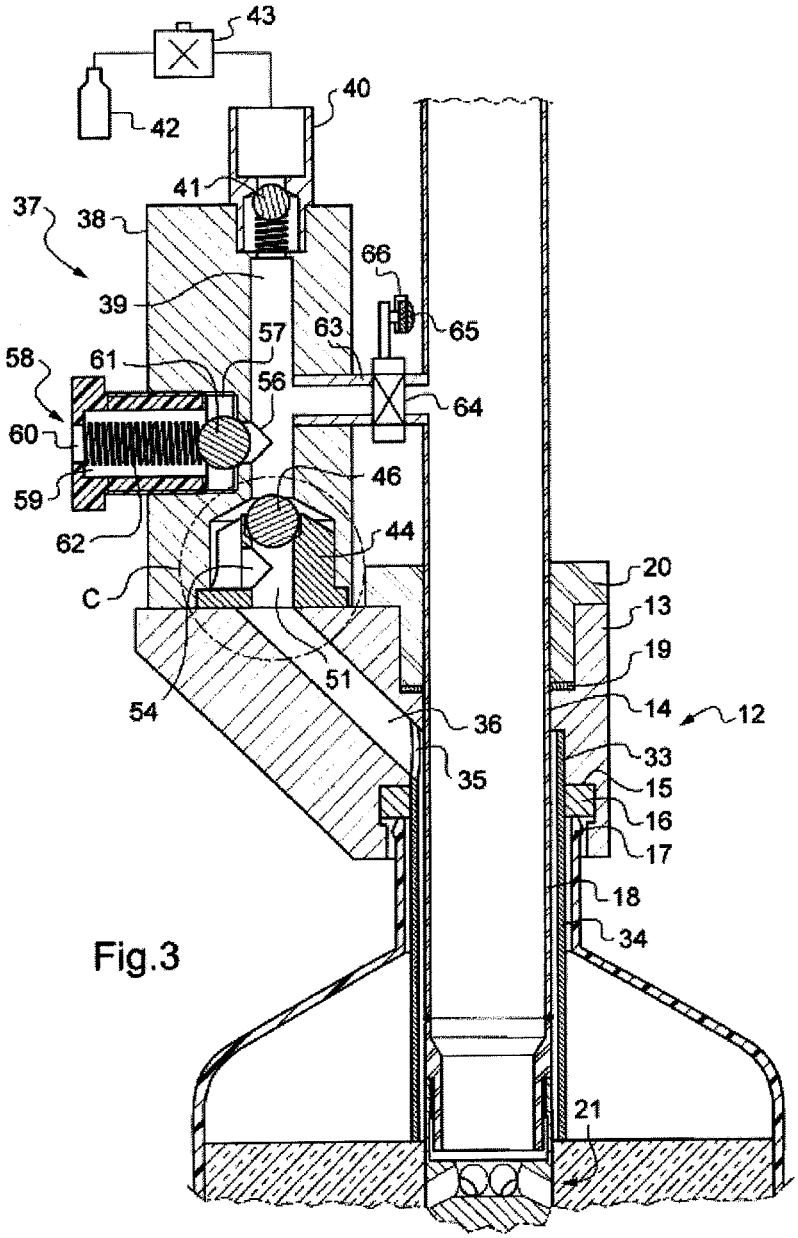
FIG. 3 is a highly enlarged cross-sectional view of the box B in FIG. 1, according to the line III-III in FIG. 1.
Figure 4:
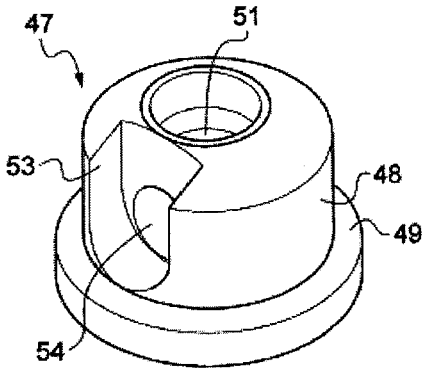
FIG. 4 is an enlarged perspective view of the exhaust check valve guide according to the invention.

With reference to FIG. 3, the body 38 in addition comprises a drilling 56 oriented transversally to the drilling 39 and associated with a bore 57, into which is screwed a bushing 58, the central tube 59 of which bushing forms a part of the exhaust duct and discharges to the exterior of the body 38 via a vent orifice 60. The bore 57 has a diameter greater than the drilling 56, and the recess produced by this means forms a seat for a ball 61 biased towards the latter by a spring 62 arranged in the central tube of the bushing 58, and the bearing force of which is determined by the tightening of the bushing 58. The bushing 58, the ball 61 and the spring 62 thus form a calibrated valve between the exhaust orifice 45 and the vent orifice 60.

Still with reference to FIG. 3, the upper extremity of the longitudinal drilling 39 is equipped with a device for injecting gas under pressure comprising a bushing 40, installed in which is a non-return valve 41. The bushing 40 is connected to a source of gas under pressure, such as a nitrogen cylinder 42, by means of a valve 43, the position of which is controlled by an actuating device such as a guide roller associated with a cam, not illustrated here.

Furthermore, the filling nozzle according to the invention comprises a connecting tube 63 discharging on the one hand into the distribution tube 18 and on the other hand into the drilling 39. A valve 64 is installed in the connecting tube 63, and its position is determined by a control device such as a guide roller 65 associated with a retractable cam 66.

The device thus described serves to implement the method according to the invention as described below. The calibrated valve 61 is first of all regulated so as to close the exhaust duct according to a calibration to the maximum exhaust pressure that it is wished to achieve inside the container in the course of its filling, the said calibration pressure being lower, of course, than the distribution pressure. A container to be filled is positioned resting against the annular connection part. If necessary, as a function of the desired filling conditions, a gas at a pressure not exceeding the exhaust pressure is injected into the exhaust duct. It should be noted in this respect that, because of its weight, the exhaust check valve 46 normally rests against the lower seat 55. Furthermore, because of the existence of the by-pass tube 53 and the dimensional variation between the drilling 51 and the bore 52, the exhaust check valve is held against the lower seat 55 with a force which increases in proportion to the level of the pressure inside the exhaust duct.

The distribution valve is now open, and the liquid then flows into the container at a rate of flow which is a function of the difference between the distribution pressure and the pressure inside the container. When the liquid reaches the lower extremity of the tube 34, as illustrated in FIG. 3, the liquid rises in the exhaust duct. When it reaches the bushing 47, the liquid rises simultaneously in the drilling 51 and in the by-pass tube 53, although because of the difference in volume between the by-pass tube and the drilling 51, the liquid rises more rapidly in the drilling 51 than in the by-pass tube in such a way that the exhaust check valve is forced against the upper seat 45 before the liquid reaches it via the by-pass tube. When the exhaust duct is closed by the exhaust check valve 46, the liquid ceases to flow into the container. The distribution valve 25 is then closed, and the container is lowered in order to release it from the joint 16. The neck of the container is now vented and, because of the gas under pressure trapped between the calibrated valve 61 and the exhaust check valve 46, the latter is pushed abruptly downwards and the liquid that is present inside the exhaust duct is expelled towards the container.

Of course, the invention is not limited to the described embodiment, and variant embodiments can be included without departing from the context of the invention as defined by the claims.

In particular, even though the invention has been described in relation to a filling nozzle connected to a device for injecting a gas under pressure, which permits a high pressure to be reached very rapidly in the interior of the container, the method according to the invention can be implemented without the prior injection of gas under pressure, the pressure ultimately reached inside the container being solely a function of the quantity of liquid introduced into the container and the calibration of the valve 61.

Although the invention has been described in relation to a filling nozzle comprising a connecting tube 63 between the liquid distribution tube and the exhaust duct in order to simplify the washing circuit and the washing operation, provision can also be made for the separate supply of a cleaning liquid to the distribution tube on the one hand, and to the exhaust duct on the other hand, by installing a device for the injection of a cleaning liquid on the body 37. Whether the washing product is fed into the exhaust circuit via the connecting tube or via an independent injection device, it may in any event be recovered below the filling nozzle via a common collector on the distribution tube and on the exhaust duct.

The invention claimed is:

1. Method for filling containers under pressure and to a constant level by means of a filling nozzle, the filling nozzle comprising:

an annular connection part configured to provide a liquid-tight support with a neck of a container, a distribution tube connected to a source of supply of a liquid under a distribution pressure by means of a distribution valve, a lower extremity of the distribution tube extending into the interior of the container, the lower extremity defining a distribution zone in the interior of the container, an exhaust duct discharging on the one hand into the distribution zone, and on the other hand via a vent orifice, and an exhaust check valve controlled by a liquid level sensor in the exhaust duct, interposed in the exhaust duct between the distribution zone and the vent orifice, the method comprising the step of:

closing the exhaust duct in a calibrated manner according to a calibration to an exhaust pressure that is lower than the distribution pressure, between the exhaust check valve and the vent orifice, placing into position a container to be filled, resting against the annular connection part, opening the distribution valve and keeping it open until the closure of the exhaust check valve, closing the distribution valve, releasing the container from the annular connection part.

2. Method for filling according to claim 1, further comprising the step of injecting into the exhaust duct, after placing a container in position, a gas at a pressure not exceeding the exhaust pressure.

3. Method for filling according to claim 2, wherein the injected gas is an inert gas.

4. Filling nozzle comprising:

an annular connection part configured to provide a liquid-tight support with the neck of a container, a distribution tube connected to a source of supply of a liquid under a distribution pressure by means of a distribution valve, a lower extremity of the distribution tube extending into the interior of the container, the lower extremity defining a distribution zone in the interior of the container, an exhaust duct discharging on the one hand into the distribution zone, and on the other hand via a vent orifice, and an exhaust check valve controlled by a liquid level sensor inside the exhaust duct, interposed in the exhaust duct between the distribution zone and the vent orifice, a calibrated valve installed between the exhaust check valve and the vent orifice.

5. Filling nozzle according to claim 4, further comprising a gas injection device arranged to permit the injection of gas into a container resting against the annular connection part.

6. Filling nozzle according to claim 5, wherein the gas injection device discharges into the exhaust duct between the exhaust check valve and the vent orifice.

7. Filling nozzle according to claim 4, wherein the exhaust duct comprises a part extending in a concentric manner to the distribution tube.

8. Filling nozzle according to claim 4, further comprising a connecting tube discharging on the one hand into the distribution tube, and on the other hand into the exhaust duct, between the exhaust check valve and the vent orifice, and a valve installed in the connecting tube.

9. Filling nozzle according to claim 4, wherein the exhaust check valve is arranged inside a closed enclosure having an upper wall comprising an exhaust orifice surrounded by an upper seat for the exhaust check valve, in that the exhaust check valve is a non-return valve installed in such a way as to slide in a valve guide comprising a guide tube having a lower extremity communicating with the exhaust duct and an upper extremity that is coaxial with the upper seat of the exhaust check valve, and in that the exhaust check valve is installed in the guide tube with a free play creating a sufficient loss of pressure for the exhaust check valve to be forced back in the manner of a piston by liquid penetrating into the enclosure via the exhaust duct.

10. Filling nozzle according to claim 4, wherein the distribution valve comprises a ball actuated by a magnetic actuator comprising a finger carried by a cylindrical magnetic armature in the interior of the distribution tube, a magnetic ring installed in an axially mobile manner on the distribution tube and surrounding the latter at the level of the magnetic armature, and an actuating device for the magnetic ring.

* * * * *